US007482917B2

(12) United States Patent
Rhodes et al.

(10) Patent No.: US 7,482,917 B2
(45) **Date of Patent: *Jan. 27, 2009**

(54) INTEGRATED COMMUNICATION OF BUILDING CONTROL SYSTEM AND FIRE SAFETY SYSTEM INFORMATION

(75) Inventors: Neil Rhodes, Evanson, IL (US); Tom Rule, Arlington Heights, IL (US); John Faragoi, Glen Ellyn, IL (US); James Han, Long Grove, IL (US)

(73) Assignee: Siemens Building Technologies, Inc., Buffalo Grove, IL (US)

( * ) Notice: Subject to any disclaimer, the term of this patent is extended or adjusted under 35 U.S.C. 154(b) by 19 days.

This patent is subject to a terminal disclaimer.

(21) Appl. No.: 11/438,932

(22) Filed: May 23, 2006

(65) Prior Publication Data

US 2006/0220827 A1 Oct. 5, 2006

Related U.S. Application Data

(63) Continuation of application No. 10/434,390, filed on May 8, 2003, now Pat. No. 7,049,951.

(51) Int. Cl.
*G08B 23/00* (2006.01)

(52) U.S. Cl. ..... 340/500; 340/286.01; 340/286.05; 340/525; 340/628; 345/1.1; 345/440; 345/502; 345/619; 345/661

(58) Field of Classification Search ..... 340/500, 340/286.01, 286.05, 525, 628; 345/1.1, 440, 345/502, 619, 661

See application file for complete search history.

(56) References Cited

U.S. PATENT DOCUMENTS 5,297,252 A * 3/1994 Becker ..... 715/803
5,977,872 A * 11/1999 Guertin ..... 340/515
6,292,106 B1 * 9/2001 Solinsky et al. ..... 340/825.49
6,542,812 B1 * 4/2003 Obradovich et al. ..... 701/207

* cited by examiner

*Primary Examiner*—Davetta W Goins

(57) ABSTRACT

An apparatus for displaying event information from a building system includes a display device coupled to a processing circuit. The processing circuit is operable to cause the display to display information regarding a first building system in a first portion of the display, the information being selectable and changeable by a user. The processing circuit is further operable to cause the display to display, independent of the displayed information in the first portion, an alarm graphic element in a second portion of the display, the alarm graphic element including building system event information regarding a second building system.

18 Claims, 4 Drawing Sheets

INTEGRATED COMMUNICATION OF BUILDING CONTROL SYSTEM AND FIRE SAFETY SYSTEM INFORMATION

This application is a continuation of U.S. patent application Ser. No. 10/434,390, filed May 8, 2003, which is incorporated herein by reference, and which in turn claims the benefit of U.S. Provisional Patent Application Ser. No. 60/390,341, filed Jun. 20, 2002, which is also incorporated herein by reference.

CROSS-REFERENCE TO RELATED MATERIAL

Cross-reference is made to co-pending application, U.S. patent application Ser. No. 10/434,491, filed on May 8, 2003, entitled "Alarm Graphic Editor With Automatic Update", which is owned by the owner of the present application and incorporated herein by reference. Cross-reference is also made to co-pending application, U.S. patent application Ser. No. 10/434,388, filed on May 8, 2003, entitled "Smoke Detector Maintenance Indication Method and Apparatus", which is owned by the owner of the present application and incorporated herein by reference.

FIELD OF THE INVENTION

The present invention relates generally to data communication and /or display methods in building systems, and more particularly, to data communication and/or display methods for fire safety system and other building control systems.

BACKGROUND OF THE INVENTION

Buildings typically include various infrastructure systems that are directed to maintaining the buildings' safety and habitability. Such building systems include fire safety systems, security systems, building automation systems and other building control systems. Fire safety systems are systems include the distributed devices that detect fire or smoke conditions and notify building occupants, building management, and emergency personnel. Security systems are systems that include distributed surveillance devices and networks, building access alarm equipment, notification networks, and other building security-related equipment. Building automation systems include heating, ventilation and air conditioning ("HVAC") equipment and may include lighting or other environment-controlling equipment. Building automation systems may further include devices that control elements of an industrial process, such as factory equipment. Such systems are well known.

Most building systems are networked, at least individually, so that one or more control stations may monitor the building-wide conditions pertaining to each particular system. For example, a fire safety system network allows for one or more control stations to monitor alarm conditions as well as equipment maintenance conditions.

Similarly, a building comfort system is networked to allow for centralized monitoring of temperature and air quality, and for control over temperature "thermostat" settings and the like. An example of an extensively networked building automation system is the APOGEE® system available from Siemens Building Technologies, Inc. of Buffalo Grove, Ill.

Generally, control stations for various building systems are located in one or more centralized "operations" areas of facilities. One operations area may cover several buildings in a campus. By use of networking, a single building may include several operations areas, each capable of accessing building system data and even controlling building system operation. For example, the APOGEE® system, described above, allows a building automation system to employ several INSIGHT® workstations dispersed throughout different locations within the facility, and even in remote locations external to the facility. Such a system provides flexibility and convenience in the control and monitoring of large systems.

In the past, the various types of building systems within a facility were largely separate and unintegrated. For example, a fire safety system and an HVAC system within a building would utilize separate networks, control terminals, and software. As a consequence, a common configuration of a facilities management area within a building would typically include one or more computer workstations provided monitoring of and control over the building comfort system, another computer workstation provided monitoring of and control over the fire safety system, and so forth One drawback of the use of separate isolated building systems is the cost associated with maintaining and using separate dedicated computer hardware and software. Another drawback is the inability to conveniently review data from multiple systems in a contemporaneous manner. For example, if a smoke alarm is received in the fire safety system, it may be useful to obtain temperature information from the HVAC system to determine whether a fire condition exists and, if so, to determine its severity. If the operator must move between several workstations, possibly in different rooms or stations, then the review of fire safety system data and HVAC data is difficult.

Still another drawback is the complexity associated with using interfaces with several unrelated systems. In particular, the building operations personnel may be required to learn different protocols and/or user interface controls associated with each of a building's system.

One of the reasons that building systems tend to employ different networks and interfaces arises from the fact that the different types of building systems have particular communication and messaging needs. By way of example, a fire safety system is required by industry and governmental standards to employ certain networking and event notification conventions. These fire safety conventions do not apply to other systems such as HVAC systems, and do not account for the types of data monitoring and control required of other systems.

Whatever the reasons for the current state of the art, there is an increasing need for an arrangement of building system interface equipment that avoids at least some of the above-described shortcomings of using separate interface computers for different building systems, while retaining features and standards beneficial to each type of system.

More specifically, there is a need for an arrangement of building system interface equipment for use with multiple types of building systems that avoids redundancy in computer hardware.

Another drawback of building system interfaces relates specifically to the manner in which alarm is displayed. For example, a fire safety system may generate and display alarm information if one or more smoke detectors within the system detect the presence of smoke. Because of industry and/or governmental standards, a user or operator must be notified immediately after the control workstation receives an event message. To this end, most fire safety interfaces employ software that "takes over" any currently displayed information when an event message is received. Such systems further typically require acknowledgement of the alarm before allowing the user to continue with other activities.

While such a system helps assure that alarms are not ignored, it is not without drawbacks. In particular, the use of such a system can become cumbersome when multiple alarms are received from multiple devices for the same event. For example, if multiple redundant alarms are received, then the software will typically prevent the user from performing other functions on the control workstation until the user has performed the acknowledgement process on all of the alarms. However, in the case of an emergency, it may be useful for the user to perform some other workstation functions after acknowledging only one or a few of the alarms.

Accordingly, there is a further need for a method and/or arrangement for presenting fire event messages in a manner that allows for other control and/or monitoring activities to be carried out on the same workstation.

SUMMARY OF THE INVENTION

Embodiments of the present invention address the above needs, as well as others, by providing an alarm graphic element on a display concurrent with, and independent of, other graphic information on the display. The other graphic information may change (for example, in response to a user request), but such change would not change affect the display of the alarm graphic element. Thus, the alarm graphic element may be used to provide alarm or event information independent of other graphic information is displayed. Such embodiments may be used to provide display of event messages to be acknowledged while also allowing the user to perform other functions using the other graphic information on the display. Moreover, the alarm graphic element may be used to provide the industry required fire alarm information while allowing display of data from other building systems in the other graphic information.

A first embodiment of the invention is a method of displaying event information from a building system. An event is a non-normal condition generated within a building system. The method includes displaying information regarding a building system on a first portion of a display, the information being selectable and changeable by a user. The method further includes displaying, independent of the displayed information on the first portion, an alarm graphic element on a second portion of a display, the alarm graphic element including building system event information.

Another embodiment of the invention is an apparatus for displaying event information from a building system. The apparatus includes a display device coupled to a processing circuit. The processing circuit is operable to cause the display to display information regarding a building system in a first portion of the display, the information being selectable and changeable by a user. The processing circuit is further operable to cause the display to display, independent of the displayed information in the first portion, an alarm graphic element in a second portion of the display, the alarm graphic element including building system event information.

By displaying event (e.g. alarm) information independently in an alarm graphic element, the user may utilize the other portion of the display for other system information.

The above described features and advantages, as well as others, will become readily apparent to those of ordinary skill in the art by reference to the following detailed description and accompanying drawings.

DETAILED DESCRIPTION

Figure 1:
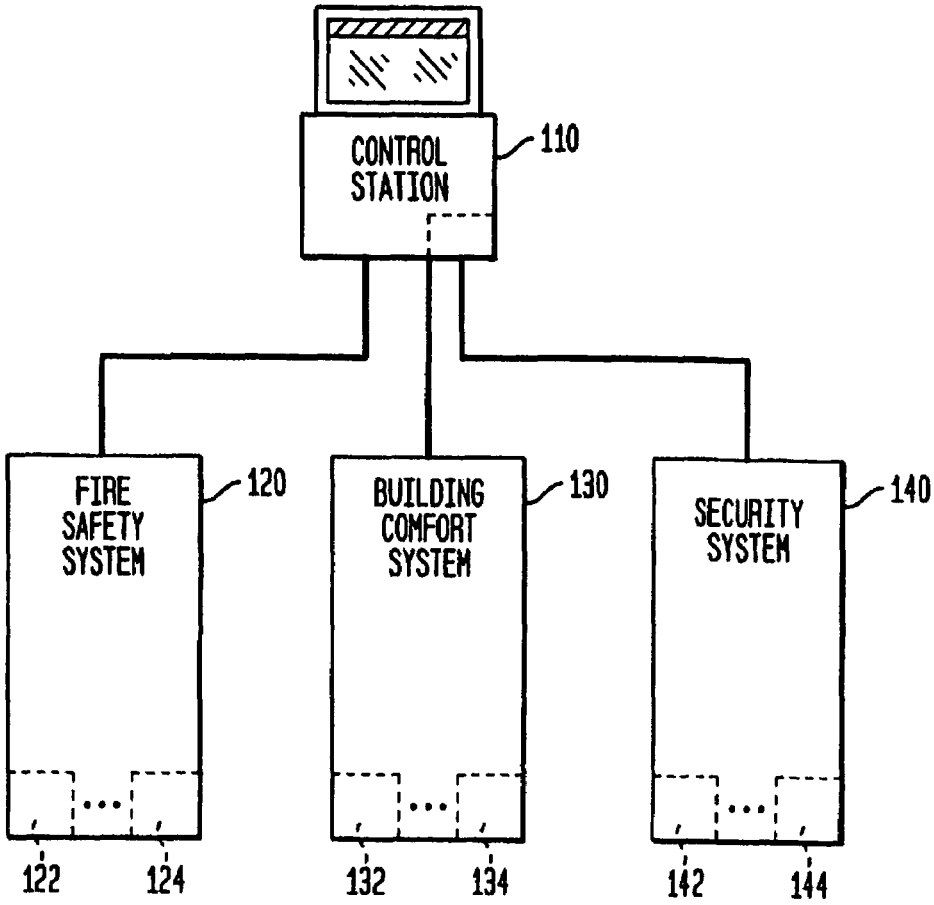
FIG. 1 shows a block diagram of an exemplary arrangement for generating and obtaining alarm and other event information from a plurality of building systems that incorporates aspects of the present invention.

FIG. 1 shows a block diagram of an exemplary arrangement 100 for generating and obtaining alarm and other event information from a plurality of building systems 100. The arrangement includes a control station 110, a fire safety system 120, a building automation system 130, and a building security system 140.

The fire safety system 120 is an integrated system that includes a plurality of fire system devices (e.g. 122, 124) that perform any of a number of fire safety system functions. These functions may include smoke detection, fire detection, audible and visible notification of alarms, local control and communication, and others known in the art. The fire alarm system 120 is operable to perform the detection and notification functions normally associated with fire alarm systems. As one of the functions, the fire safety devices (including devices 122 and 124) are operable to communicate event messages to the control station 110 over one or more communication networks. An event message typically communicates information regarding a non-normal condition. The event messages may relate to detected fire conditions, communication problems, equipment trouble, or other information that indicates that equipment within the fire safety system 120 requires action or further review. An event message may also include a "return to normal" message indicating that the non-normal condition referenced in a previously received event message has been resolved.

In general, fire safety systems having such capabilities are well known in the art. An exemplary fire safety system is disclosed in co-pending patent application Attorney Docket No. 1867-0026, entitled "Alarm Graphic Editor With Automatic Update", which is incorporated herein by reference.

In the exemplary embodiment described herein, the building automation system 130 is an integrated building comfort or HVAC system. To this end, the building automation system 130 includes a plurality of building system devices (e.g. 132, 134) that perform any of a number of building environmental system functions. Building system devices may include, for example, temperature sensors, heating and/or cooling valves, ventilation dampers and actuators, chiller plants, control and communication devices, and other devices normally used in HVAC systems of different sizes. The building automation system 130 is operable to perform the control and measurement operations relating to temperature, air quality and other comfort or environment factors normally associated with building automation systems. As one of the functions of the building automation system 130, the building system devices (including devices 132 and 134) are operable to communicate alarm and other event messages to the control station 110. The event messages may relate to out of boundary conditions, communication problems, equipment trouble, or other non-normal conditions. An event message typically indicates that equipment within the building automation system 130 may require action or further review. Event messages may also suitably include "return to normal" messages as discussed above.

Building automation systems having the capabilities discussed above are known in the art. An exemplary building automation system is the APOGEE™ system, described further above, which is available from Siemens Building Technologies, Inc.

The security system 140 is an integrated system that includes a plurality of building security devices (e.g. 142, 144) that perform any of a number of building security functions. Building security devices may include, for example, motion sensors, video monitors, key-coded entry devices, control and communication devices, and other devices normally used in security systems. As one of the functions, the security system devices (including devices 142 and 144) are operable to communicate alarm and other event messages to the control station 110. The event messages may relate to detection of movement, compromise of a door lock, actuation of a manual alarm device, communication problems, equipment trouble, or other non-normal conditions. An event message typically indicates that equipment within the building automation system 140 may require action or further review.

Such systems are well known in the art, and can vary widely in functionality and size.

Figure 2:
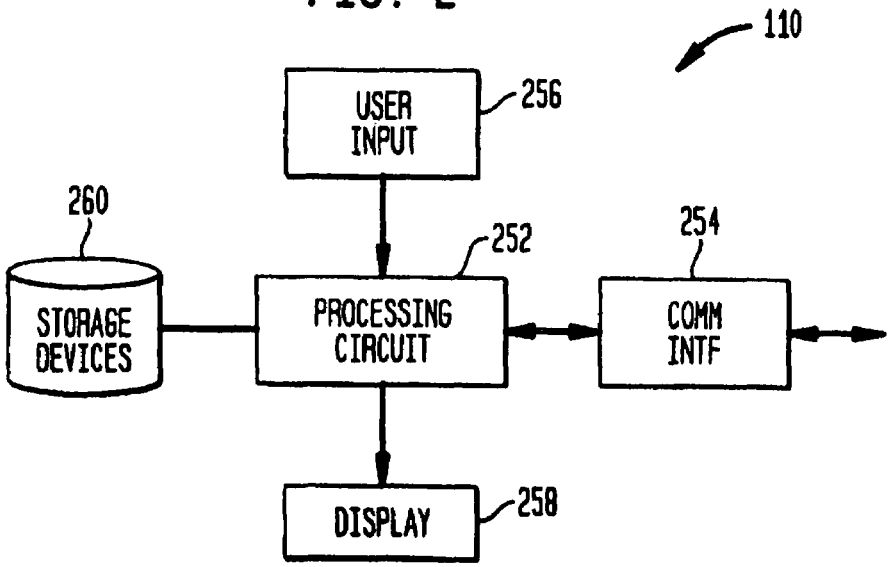
FIG. 2 shows an exemplary computing arrangement that is operable to display event information in accordance with aspects of the present invention.

Referring now to FIG. 2, the control station 110 is implemented as a general purpose computer. To this end, the control station 110 includes a processing circuit 252, a communication interface 254, a set of user input devices 256, a display 258, and storage devices 260. The control station 110 may further include a plurality of other devices, such as modems, disk arrays, printers, scanners and other devices typically employed in connection with multipurpose computers. The processing circuit 252 may suitably be a circuit that includes any suitable Pentium-class microprocessor available from Intel, or any comparably powered microprocessor. The display 258 may be any suitable display, including a CRT display, LCD display, or plasma screen display. The input devices 256 may suitably include pointing devices, keyboards, microphones or the like.

The storage devices 260 may include many types of memory associated with general purpose computers, including random access memory, permanent or removable disks or tapes and the like. The storage devices 260 may be distributed throughout various computers on a local area network, or even an enterprise-wide network. For the purposes of the invention described herein, the exact location and structure of the storage devices accessible to the processing circuit 252 is not of significant consequence.

The control station 110 generally provides centralized monitoring and control of various elements on the system 100. While at least some control over the operation of the devices of the various systems 120, 130 and 140 is necessarily external to the control station 110, the control station 110 may nevertheless perform supervisory control and monitoring functions. The general supervisory control and monitoring functions will vary from system to system. Such functions, within the framework of a fire safety system 120, a building automation system 130 and a building security system 140 are known in the art.

Individual workstations for each of the systems 120, 130 and 140 are known in the art. By way of example, the INSIGHT® Workstation, which is publicly available from Siemens Building Technologies, Inc.

In general, a user may use the control station 110 to request data from individual elements of the systems 120, 130 and 140 for display on the display device 258. By way of example, a user may request temperature measurements from a temperature sensor, or operational status information from a smoke sensor or motion sensor. The processing circuit 252 obtains the data from the relevant system 120, 130 and 140 via the communication interface 254 and then displays the information on the display 258. A user may also use the control station 110 to enter specific commands to one or more elements of the systems 120, 130 and 140. By way of example, a user may change a parameter of operation of a particular ventilation damper, or of a chiller plant. The control station 110 may also perform automated control operations for any of the systems 120, 130 and 140.

In accordance with aspects of the invention, the control station 110 is also operable to receive event messages from devices on each of the systems 120, 130 and 140. The control station 110 is operable to display event condition information responsive to the event messages on the display 258. In addition, the control station 110 may be operable to cause other action in the event of certain alarms. Again, configuring a general purpose computer to perform the operations described herein would be known to those of ordinary skill in the art.

In accordance with one aspect of the present invention, a portion of the display 258 is set aside for alarm and other event information while at least another portion may be used for general purposes. To this end, the processor 252 is operable to cause the display 258 to display information regarding one or more of the building systems 120, 130 and 140 on a first portion of a display. Such information is selectable and changeable by a user, for example, through the input devices 256. The processor is further operable to display, independent of the displayed information on the first portion, an alarm graphic element on a second portion of a display, the alarm graphic element including building system event information. By independent it meant that the user may change the information displayed in the first portion of the display without changing the event information shown in the second portion. Preferably, the processing circuit 252 is programmed so that the alarm graphic element cannot be closed out while the work station 110 is operational.

Figure 3:
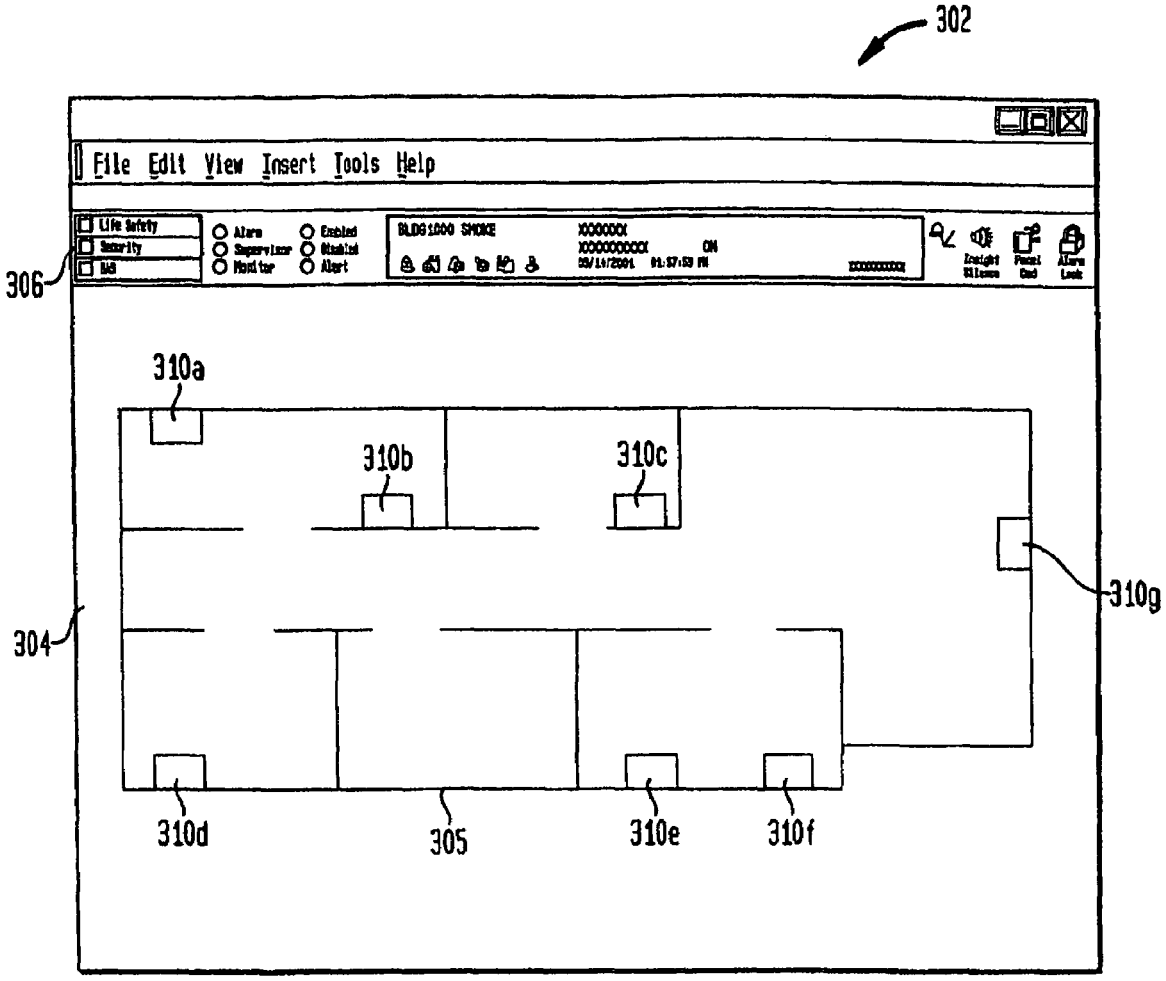
FIG. 3 shows an exemplary display of the computing arrangement of FIG. 2.

By way of example, FIG. 3 shows an exemplary illustration of a display screen 302 having a first portion 304 for general system monitoring and control and a second portion that includes an alarm graphic element 306. The display screen 302 may suitably employ the WINDOWS® operating system interface, available from Microsoft Corporation of Redmond, Wash.

In the exemplary embodiment shown in FIG. 3, the first portion 304 includes a floor plan graphic 305 representative of one section of the facility being monitored, and may display graphic elements 310*a*-310*g* which are representative of devices in one or more of the systems 120, 130 and 140. For example, the user may have elected to show a floor plan of a particular area showing the status of fire system alarm generating devices in the area. In such a case the elements 310*a*-310*g* would all represent fire alarm initiation devices in the system. However, it will be appreciated that the user may elect to do any number of building system operations that cause graphic or other display of system elements and/or data generated by such elements.

An advantage of this aspect of the invention is that important alarm or event messages may be communicated via the display 258 even though a user may be viewing data or information unrelated to the system or device that generated the event message. This advantage allows a user to, among other things, obtain more information regarding an event message that is displayed on the alarm graphic element 306 by viewing other related system data in the first portion 304. By contrast, prior art devices that interrupt and "take over" the entire display 258 to provide event message data prohibits the user from taking other actions or reviewing other data until the user "resolves" or at least "acknowledges" each event message. Thus, the system 100 described above allows for both constant display of event information while also allowing other control and monitoring operations to utilize the display 258.

While the alarm graphic element 306 is displayed independent of other information displayed, the control station 110 is nevertheless preferably configured to allow the user to alter the appearance of the alarm graphic element 306 to a limited degree, as will be discussed below in connection with FIGS. 4*a* through 4*c*.

In particular, the graphic alarm element 306 in the embodiment described herein includes a number of graphic indicators showing information regarding one or more event conditions. The configuration of the alarm graphic element 306 may be altered to focus on event conditions from different systems. However, at least some event information from all systems 120, 130 and 140 are displayed regardless of configuration of the element 306.

Figure 4A:
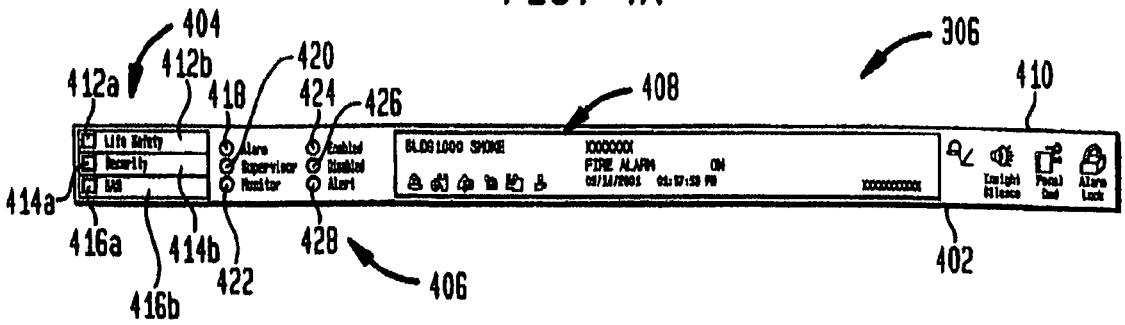
FIG. 4*a* shows a first exemplary configuration of the alarm graphic element of the display of FIG. 3.
Figure 4B:
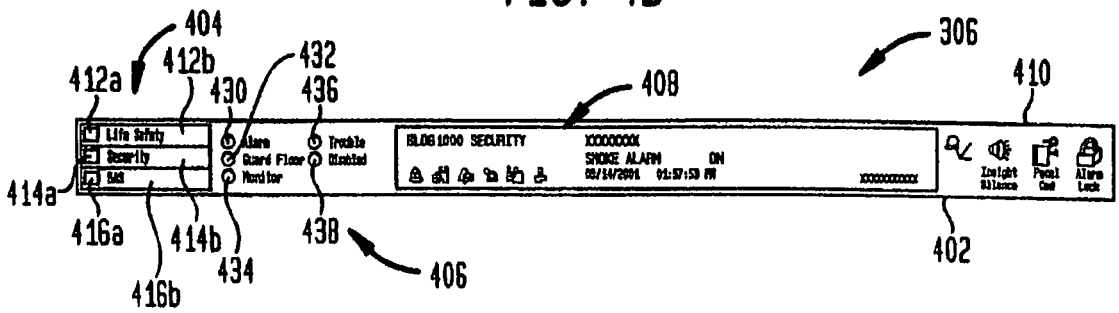
FIG. 4*b* shows a second exemplary configuration of the alarm graphic element of the display of FIG. 3.
Figure 4C:
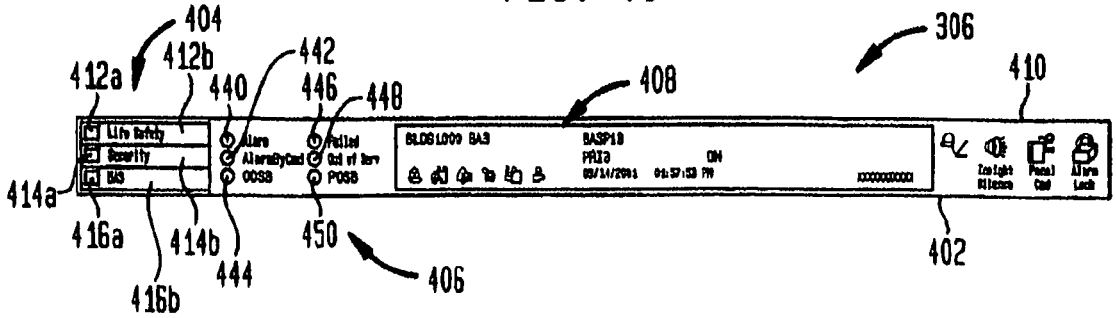
FIG. 4*c* shows a third exemplary configuration of the alarm graphic element of the display of FIG. 3.

FIGS. 4*a*, 4*b* and 4*c* show in further detail three different user-selectable configurations of the graphic alarm element 306 of the present embodiment. The graphic alarm element 306 is contained within a rectangular bar 402, and includes a number of interactive graphic elements. A first set of elements are system level elements 404 that provide system-level event indicators and allow for selection of a particular system for which additional alarm detail is desired. A second set of elements are message type elements 406 that provide information on specific event message types within a particular system. A third element is a message detail block 408 that contains details regarding a particular event message. Other elements 410 provide interactive capabilities to acknowledge particular events, obtain information regarding certain events, and other user interactive devices.

The system level elements 404 include a graphic "LED" type indicator and a selectable graphic button or "tab" for each system supported by the control station 110. In particular, the system level elements 404 in the exemplary embodiment described herein include a fire or life safety system LED 412*a* and a life safety system tab 412*b*, a security system LED 414*a* and a security system tab 414*b*, and a building automation system LED 416*a* and a building automation system tab 416*b*.

The graphic LEDs 412*a*, 414*a* and 416*a* are simply graphical boxes having one of a select number of colors representative of a particular state. For example, a red-filled box may represent a highest priority event, an orange-filled box may represent a medium priority event, and a yellow-filled box may represent a low priority event. A box filled with grey, black or white may represent the presence of no event. A green-filled box may suitably represent the receipt of a "return to normal" event corresponding to a previously received event message. Preferably, the control station 110 includes software that allows the user to custom define the relationship between certain event messages and LED colors. It will be nevertheless appreciated that the selection of LED colors as described herein is merely exemplary.

A graphic "tab" is an interactive graphical device, well known in the art, that represents a particular input selection. A tab is typically "selected" when the user positions a cursor over the graphical device and depresses a manual selection element on a pointer device, such as a mouse. Such graphic tabs are well known in the art.

In general operation, the highest priority unresolved event message for each system defines the color of the LED for that system in the system level elements 404. In the exemplary illustration described herein, the life safety system LED 412*a* is red, identifying that a high priority life safety event message has been received and has not yet been resolved. By contrast, the security system LED 414*a* and the building automation system 416*a* have a grey or inactive color, thereby signifying that no active event messages exist for the security system 140 and the building automation system 130, respectively. Referring briefly to FIG. 4*b*, it can be seen that the security system LED 414*a* and the life safety system LED 412*a* are red, indicating that a fairly high priority event message has been received from both systems.

The tabs 412*b*, 414*b*, and 416*b* allow the user or operator to select to view further detail regarding the respective system. For example, selection of tab 416*b* allows the user to select to view additional detail regarding the building automation system 130. In general, FIG. 4*a* shows the configuration of the alarm graphic element 306 when the fire safety system tab 412*b* has been selected, FIG. 4*b* shows the configuration of the alarm graphic element 306 when the security system tab 414*b* has been selected, and FIG. 4*c* shows the configuration of the alarm graphic element 306 when the building automation system tab 416*b* has been selected Referring again generally to FIGS. 4*a*-4*c*, the message type elements 406 include a graphic "LED" type indicator with associated static text. The configuration of message type elements 406 depends at least in part on the selected system.

For example, in FIG. 4*a*, the life safety system tab 412*b* has been selected as indicated by the bold or emphasized text on the life safety system tab 412*b*. As shown in FIG. 4*a*, when the fire safety system tab 412*b* is selected, the message type elements 406 include a labeled "Alarm" LED graphic 418, a labeled "Supervisory" LED graphic 420, a labeled "Monitor" LED graphic 422, a labeled "Trouble" LED graphic 424, a labeled "Disabled" LED graphic 426, and a labeled "Alert" LED graphic 428. The graphics 418-428 represent different event message types that may be generated within the building fire safety system 120. The event message types relate to the type and/or severity of event condition that is denoted by the event message.

In the exemplary embodiment described herein, an Alarm message type relates to a fire alarm event, such as may be generated by actuation of a fire pull station or by detection of smoke at a smoke detector. Alarm message types are of the highest priority. A Supervisory message type relates to a supervisory event indicating an issue regarding one or more elements of the fire safety system, such as a closing of a water valve in a sprinkler system. A Supervisory message type may be of medium or low priority. A Monitor message may be generated when a portion of the fire safety system 120 is active, even though no fire condition has been detected. For example, if a fire fan is activated or an elevator goes into fire control mode, a Monitor message may be generated. Monitor messages may be of medium or low priority. A Trouble message type may refer to an equipment malfunction, including communication problems, within the fire safety system 120. A Disabled message indicates that a device has been purposefully disabled either by the control station 110 itself at the device itself. An Alert message may be a pre-alarm warning from a smoke detector or the like. More specifically, some systems have smoke detectors that issue alert messages for a short time before issuing a full-scale Alarm message.

If the control station 110 has received one or more event messages that are still active or unresolved, then the LED graphic corresponding to that message type will be "lit" or colored in. The color will depend on the severity of the event, and will typically be defined specifically for each implementation, as discussed above. Alarm messages are always "red", while a Disabled message may be "orange" or "yellow", and a Trouble message may be "orange". If an event message has not been "acknowledged", the corresponding LED will "blink", or in other words, alternate between an event indicator color and the "empty box" color (i.e. grey). If an event message has been "acknowledged", but not resolved, then the corresponding LED will remain lit constantly. If an event condition that created an event message has returned to normal, and a corresponding "return to normal" event message is received, then the LED will be "green" until acknowledged. Once a return to normal event message is acknowledged, then the LED will return to the empty box color.

To this end, the system 100 and particularly the control station 110 employ an event message management system well known in the art that defines and tracks multiple possible states for event conditions. An event condition may suitably have the following states: unacknowledged, acknowledged, return to normal or resolved. More or less states may be used. A newly received event message is typically in the unacknowledged state until it is satisfactorily acknowledged by an operator. To this end, the control station 110 may require a number of manual inputs or actions that constitute "acknowledgement" of the event message. A purpose of the "acknowledgement" step is to allow the operator to distinguish between event conditions of which the operator is already aware and new event conditions.

A return to normal state of an event condition is typically received as a separate event message that relates to a previous event message (either acknowledged or unacknowledged).

An event condition is in the resolved state when the return to normal event message has been acknowledged. In the embodiment described herein, an "active" event message is an event message that is not in the resolved state. As a consequence, the control station 110 may have active event messages that are either acknowledged, unacknowledged, or in the return to normal.

Fire safety systems having the capability to detect conditions described above and the capability to communicate event message types responsive to detecting such conditions would be known to those of ordinary skill in the art.

It will be appreciated that the exact message types and the selection of their priorities will vary from implementation to implementation. Similarly, levels of acknowledgement and resolution of alarm conditions may vary from system to system. The above description is provided as an illustrative example of how such elements may incorporate the present invention.

FIG. 4*b* shows another exemplary display of the graphic element 306. In FIG. 4*b*, the building security system tab 414*b* has been actuated, and active events are present in both the building security system 140 and the fire safety system 120, as indicated by the LEDs 412*a* and 414*a*.

When the security system tab 414*b* is selected as shown in FIG. 4*b*, the message type elements 406 include a labeled "Alarm" LED graphic 430, a labeled "Guard Tour" LED graphic 432, a labeled "Monitor" LED graphic 434, a labeled "Trouble" LED graphic 436, and a labeled "Disabled" LED graphic 438. While many of the message types are similar, or have similar names as those used in the fire safety system 120 discussed above, the message types collectively are specific to the building security system.

In the exemplary building security system described herein, the Alarm message type is a message generated indicating an unauthorized intrusion or compromise of a security barrier. A Guard Tour message type is a message indicating that a guard tour is in progress and that a certain check point has not been reached within the normal time parameter. For example, a Guard Tour may require a certain sequence of check points within a certain time period. If the check points are not acknowledged by the touring guard, and event condition exists. A Monitor message, similar to the Monitor message of the fire safety system, relate when a portion of the fire safety system 120 has been activated, but no other event condition appears to be have occurred. Monitor and Guard Tour messages may be of medium or low priority. A Trouble event message refers to an equipment malfunction, including communication problems, within the building security system 120. A Disabled message indicates that a device has been purposefully disabled either by the control station 110 or at the device itself.

Security systems are well known, and devices for use in security systems that are capable of generating event messages of the various types identified above, and/or analogous event message types, are also known in the art.

The operation of alarm graphic element 306 when the security system tab 414*b* is actuated is similar to that described above in connection with when the fire safety system is actuated. In particular, if the control station 110 has received one or more event messages that are still active for any message type, then the LED graphic corresponding to that message type will be "lit" or colored in. The color will depend on the severity of the alarm. If an event message has not been "acknowledged", the corresponding LED will "blink", while an acknowledged but unresolved event message will cause the corresponding LED to remain lit constantly. An unacknowledged "return to normal" message will cause the corresponding LED to blink a different color, such as green.

When the building automation system tab 416*b* is selected as shown in FIG. 4*c*, the message type elements 406 include a labeled "Alarm" LED graphic 440, a labeled "AlarmByCmd" LED graphic 442, a labeled "ODSB" LED graphic 444, a labeled "Failed" LED graphic 446, a labeled "Out-of-Serv" LED graphic 448, and a labeled "PDSB" LED graphic 450.

In the exemplary building security system described herein, the Alarm message type is a message generated by a system device that indicates that a measured parameter, e.g. temperature or flow, is out of acceptable range. Alarm messages may have multiple priority levels. An AlarmByCmd message type is a message indicating that an event message has been manually generated within the building automation system 130 by an operator. An ODSB message type is a message that indicates that the event condition reporting function of a device has been disabled by an operator. A Failed message identifies that a device in the building automation system 130 has failed. An Out-of-Serv message identifies that a device is out of service. A PDSB message indicates that the event condition reporting function of a device has been disabled by the control station 110 or another automated computer or device.

Building automation systems are well known, and devices for use in building automation or automation systems that are capable of generating event messages of the various types identified above, and/or analogous event message types, would be known to those of ordinary skill in the art. Priority levels assigned to such message types are a matter of design choice.

The operation of alarm graphic element 306 when the building security system tab 416*b* is actuated is similar to that described above in connection with when the fire safety system tab 412*b* is actuated (FIG. 4*a*) and when the building security system tab 414*b* is actuated (FIG. 4*b*).

To carry out the display operations described above, the processing circuit 252 generally maintains in one of the storage devices 260 a message file or list associated with each building system. Thus, in the exemplary embodiment shown in FIGS. 1, 4*a*, 4*b*, and 4*c*, the processing circuit 252 maintains a fire safety message list, a building automation message list, and a building security message list. The processing circuit 252 references these lists to generate the alarm graphic element 306. In the embodiment described herein, the lists are referred to as event message lists, which comprise lists of event message records. The exact method of storing received event message information may suitably take other forms as would be known to those of ordinary skill in the art.

In operation, when an event message is received from a device on one of the systems 120, 130 or 140, the processing circuit 252 stores the message in the appropriate event message list. When the display of the alarm graphic element 306 is to be refreshed, the processing circuit 252 obtains the event message information from the event message lists to determine which LED graphics to "light" and/or "blink" and what details to place in the detail block 408.

Figure 5A:
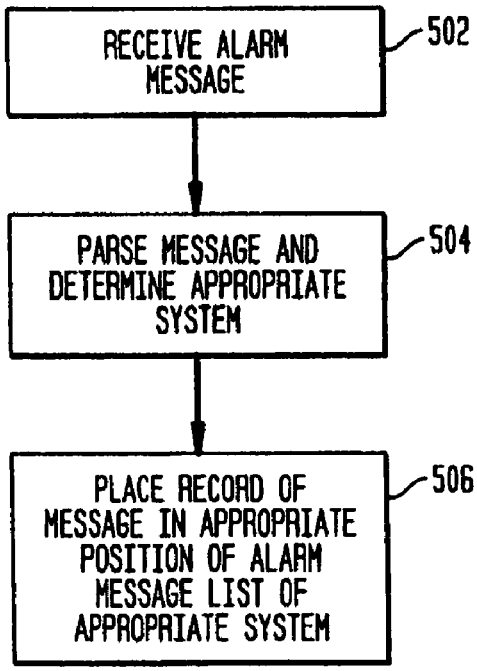
FIG. 5*a* shows a flow diagram of an exemplary set of steps carried out when a new event message is received by the computing arrangement of FIG. 2.

FIG. 5*a* shows a flow diagram of an exemplary set of operations performed by the processing circuit 252 upon receiving an event message from any of the systems 120, 130 or 140 of FIG. 1. In general, the processing circuit 252 stores the event message information such that it may be accessed when the display of the alarm graphic element 306 is to be refreshed. To this end, in the exemplary embodiment of FIG. 5*a*, the processing circuit 252 inserts a record of the event message in a particular position on a select one of the event message lists.

More specifically, in step 502, the processing circuit 252 receives an event message from one of the systems 120, 130 or 140. It will be appreciated that the systems 120, 130 or 140 may or may not use the same communication protocol. In either event, the communication interface 254 and the processing circuit 252 are configured to be able to receive and parse messages of many types, including the various types of event messages from each of the systems 120, 130 and 140.

In step 504, the processing circuit 252 parses the received message to determine, among other things, the system to which the message pertained. The processing circuit 252 then identifies the appropriate event message list in which to store the message. For example, if the message was generated within the building security system 140, then the processing circuit 252 identifies that the message should be stored in the building security system event message list. To this end, the system identification information may be stored within the message itself, or may be determined from some data within the message.

In the embodiment described herein, each event message includes a point identifier. A point is a physical or logical location within a building system. For example, a particular smoke detector or pull station may constitute a point. In the embodiment described herein, each system has its own set of points. Thus, the control station 110 can determine the system to which the event message pertains by parsing the point identification information from the message and determining the system on which that point exists. In any event, there are multiple techniques that may be used to determine which system, the fire safety system 120, the building automation system 130, or the building security system 140, to which a received event message pertains.

In step 506, the processing circuit 252 updates the event message list for the system identified in step 504. To this end, the processing circuit 252 forms a data record for insertion in to the relevant system list. As briefly discussed above, records of received event messages are stored in a file, and more particularly, a list, from which the alarm graphic element may be constructed. Each record includes information identifying the point or location of the alarm condition, the message type (Alarm, Monitor, Supervisory, etc.), the state (acknowledged, unacknowledged, return to normal, resolved), a text description of the alarm condition, and preferably a value identifying the priority of the alarm. The record also preferably includes a date and time stamp as to when the event message was generated and/or received by the control station.

It is noted that in some embodiments, the message type will inherently imply a priority value. In such cases, the event message does not necessarily contain priority information. For example alarm type messages in the fire safety system 120 are always highest priority alarms. However, other embodiments may use multiple levels of priority for one or more message types. Such embodiments may include the priority value within the event message record.

Referring now to the event message lists, each event message list may be maintained in an order defined by state and priority value. In particular, active event messages on the list are ordered by state value first. The state hierarchy may suitably be unacknowledged, acknowledged, and then return to normal. Any messages having the same state value are then ordered by event priority value. Thus, for example, consider the three message records of the message list file for the fire safety system 120 illustrated in Table 1, below

TABLE I

| System Point | Message Type | State | Priority | Date/ Time |
|---|---|---|---|---|
| BLDG1200.NOTIF | TROUBLE | UNACK | MEDIUM | 12.18.03 17:47:32 |
| BLDG1000.SMOKE | ALARM | ACK | HIGHEST | 12.18.03 18:04:46 |
| BLDG1200.SMOKE | TROUBLE | ACK | MEDIUM | 12.17.03 23:12:00 |

In such a list, it is noted that the BLDG1200. NOTIF message is first because it is unacknowledged. The BLDG1000. SMOKE and BLDG1200. SMOKE messages follow, which are both acknowledged. However, the BLDG1000. NOTIF message is located at a higher position on the event message list because it has a highest priority value, it being an Alarm message type. By contrast, the BLDG1400. SMOKE message is a Trouble message type having only medium priority.

Thus, steps 502, 504 and 506 result in the placement of a record of each newly received message at the appropriate position of event message list of the appropriate system. By way of example, consider a newly received message BLDG1200. SMOKE-FIRE ALARM, which is an Alarm message type from a smoke detector in the fire safety system 120. In step 502, the processing circuit 252 receives the message. In step 504, the processing circuit 252 parses the message and determines that the alarm is from the fire safety system 120. In step 506, the processing circuit 252 inserts a record of the received message into the correct position of the event message list of the fire safety system. The record of the received message would be BLDG1200. SMOKE, ALARM, UNACK, HIGHEST, further including the date and time. The processing circuit 252 obtains the BLDG1200. SMOKE and ALARM by parsing the message. The processing circuit 252 adds the UNACK data because, as a newly received message, it is not yet acknowledged. The processing circuit 252 adds HIGHEST priority data either from other information parsed from the message, or by correlating an ALARM message in a fire safety system as necessarily being a HIGHEST priority.

In placing the record on the list (See table I), the processing circuit 252 sorts by state, which is UNACK, and then priority, which is HIGHEST. Using these criteria, the record of the newly received message would be placed at the top of the list for the fire safety system 120. Table II shows the revised list.

TABLE II

| System Point | Message Type | State | Priority | |
|---|---|---|---|---|
| BLDG1200.SMOKE | ALARM | UNACK | HIGHEST | 12:18.03 18:09:22 |
| BLDG1200.NOTIF | TROUBLE | UNACK | MEDIUM | 12.18.03 17:47:32 |
| BLDG1000.SMOKE | ALARM | ACK | HIGHEST | 12.18.03 18:04:46 |
| BLDG1200.SMOKE | TROUBLE | ACK | MEDIUM | 12.17.03 |

It will be appreciated that in addition to receiving new event messages, the processing circuit 252 also rearranges or sorts the list when an unacknowledged event message transitions from the unacknowledged state to the acknowledged state, or when a message transitions from the acknowledged or unacknowledged state to the resolved state. Resolved points are either deleted or temporary placed at the bottom of the list.

It will be appreciated that the exact method of arranging and maintaining event message data is predominantly a design choice. Those of ordinary skill in the art may readily store event condition information for multiple building systems in other ways that are suitable for updating an alarm graphic display in accordance with the invention.

Figure 5B:
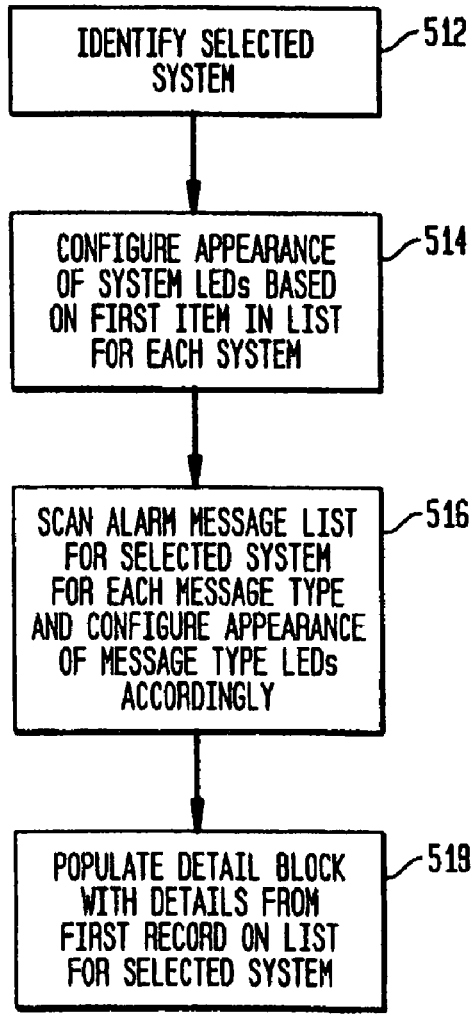
FIG. 5*b* shows a flow diagram of an exemplary set of steps carried out to display an alarm graphic element according to the present invention.

In any event, from time to time the display of the alarm graphic element 306 is refreshed. For example, the display may be refreshed when a new event message has been received. Also, the processing circuit 252 may refresh the display if the status of an event message changes. The processing circuit 252 also refreshes the display when the user selects a system tab 412*b*, 414*b*, or 416*b*. FIG. 5*b* shows an exemplary set of steps that may be performed by the processing circuit 252 to refresh the alarm graphic element 306.

First, in step 512, the processing circuit 252 identifies the current selected system. The current selected system is the system associated with the most recent actuation of one of the tabs 412*b*, 414*b*, and 416*b*. The current system in the embodiment described herein may be the fire safety system 120, the building automation system 130 or the building security system 140.

In step 514, the processing circuit 252 configures, or in other words, selects the appearance of, the system element LEDs 412*a*, 414*a*, and 416*a*. The processing circuit 252 configures the LEDs 412*a*, 414*a*, and 416*a* based on the priority level and state of the first message in the event message list associated with, respectively, the fire safety system 120, the building automation system 130 and the building security system 140. In other words, the processing circuit determines the color of, and whether to blink, the LED 412*a* by reviewing the first message on the event message list of the fire safety system 120. If the event message is stored another way, the processing circuit 252 nevertheless determines for each system the most significant event message (or condition), typically defined by state value and priority value.

In the embodiment described herein, if the first message has a priority level "highest", then the LED 412*a* will be "lit" red. The LED 412*a* will be made to blink red if that first message is also unacknowledged. If the first message is at a medium priority, then the LED 412*a* will be "lit" orange. If the first message is at a low priority, then the LED 412*a* will be "lit" yellow. If no message is present on the fire safety system event message list, then the LED 412*a* will be some color that indicates that no alarm is present, such as black, grey or white. The processing circuit 252 also determines of the color of, and whether to blink, the LEDs 414*a* and 416*a* in a similar manner.

Thus, in step 514, the processing circuit 252 determines what color to use to fill each system element LED 412*a*, 414*a*, and 416*a*, based on the priority value of the first record on the event message list (or in other embodiments, the most significant message) of each corresponding system. The processing circuit 252 further determines whether to blink each LED based on the state value of the corresponding event message. By way of example, if the list in Table II is employed as the event message list for the fire system 120, then in step 514 the processing circuit 252 would blink the LED 412*a* red because the first item on the list has a highest priority value and an unacknowledged state value.

In step 516, the processing circuit 252 generates the message type element 406 of the alarm graphic element 306. As an initial matter, the processing circuit 252 generates the template of the element 406 by placing the appropriate labeled LEDs in the element 406. The appropriate labeled LEDs are those that correspond to the message types defined for the selected system. Thus, if the selected system is the fire safety system 120, then the element 406 is configured to have the labeled LEDs 418, 420, 422, 424, 426 and 428 as shown in FIG. 4*a*.

The processing circuit 252 then determines the appearance of each message type LED in the message type element 406 by determining the most significant event message for each message type in the selected system. In the embodiment described herein, the determination of the most significant message is based on a scan of the event message list for the selected system. To this end, the processing circuit 252 scans the event message list for the first appearance of a message for each message type. Thus for example, if the selected system is the fire safety system 120, the processing circuit 252 scans the entire list for the first alarm type message, then scans the list for the first Supervisory type message, then scans the list for the first Monitor type message, and so forth. Because the event message lists are sorted in order of state and then priority, such a scan yields the message with the "highest" state (state hierarchical order being unacknowledged, then acknowledged, then return to normal) for each message type in the selected system. The processing circuit 252 then determines the appearance of each of the LEDs in the message type element 406 based on the message with the highest state of each corresponding message type.

Consider an example in which the current selected system is the fire safety system 120 and thus the message type element 406 has an appearance as shown in FIG. 4*a*, and further that the event message list for the fire safety system 120 is that shown in Table II. In such an example, the processing circuit 252 would cause the "Alarm" LED graphic 418 to blink red, the "Supervisory" LED graphic 420 to remain grey, the "Monitor" LED graphic 422 to remain grey, the "Trouble" LED graphic 424 to blink orange, and the labeled "Disabled" LED graphic 426 and the "Alert" LED graphic 428 to remain grey.

In step 518, the processing circuit 252 populates the detail block 408 with particular details of the highest priority event on the event message list of the relevant system. The details may include identification of the point on the system to which the event message pertains (and/or the source of the event message), the date and time the event message was received, and the type of event condition. All of such information is obtained from the data record in the event message list. However, in other equally suitable embodiments, such data may be stored or obtained in other ways based on the received event messages.

The processing circuit 252 may further provide additional graphics and text within the alarm graphic element 306. For example, the processing circuit 252 in the exemplary embodiment described herein (FIGS. 4*a*-4*c*) include an "Ack" tab graphic 452 that allows a user to start the acknowledgement process.

In accordance with one aspect of the present invention, selection of the "Ack" tab graphic 452 causes execution of the "acknowledge" process for one or more particular event messages. The exact operation of the acknowledge process will very from system to system, but in general is a series of operations that are designed to ensure that a human operator has taken notice of the event message being acknowledged. The acknowledgement process helps the user or operator distinguish alarms of which he or she is already aware, and newer alarms.

In accordance with one aspect of the present invention, a single acknowledgement may be used for multiple event messages pertaining to a single point or from a single source device. For example, as shown in Table II, multiple event messages may be generated by the same system point referred to as BLDG1200. SMOKE. It has been found that certain cases, a single alarm condition may cause the generation of multiple event messages of different types. Separate acknowledgement of each of the multiple event messages is often superfluous and unduly hampers useful reaction to an emergency condition. Accordingly, it is preferable, as in the embodiment described herein, to allow at least the option of allowing the user to acknowledge all unacknowledged event messages from a single point in the system. Such option may be provided by providing the user with a pull-down menu with activation of the "Ack" tab that includes several options, including acknowledgement of all alarms to one or more points for which event messages have been received.

It will be appreciated that the above described embodiments are merely exemplary, and that those of ordinary skill in the art may readily devise their own implementations and embodiments that incorporate the principles of the present invention and fall within the spirit and scope thereof. For example, many of the advantages of displaying the alarm graphic element independent may be realized even if the alarm graphic element is configured in ways other than that shown in FIGS. 3, 4*a*, 4*b* and 4*c*. Moreover, it will be realized that at least some advantages may be obtained even if the alarm graphic element is used in connection with only a single system as opposed to multiple building systems.

We claim:

1. A method of displaying event information from a building system, comprising:

a) executing a first software process to display information regarding a first type of building system on a first portion of a display, the information being selectable and changeable by a user;

b) executing a second software process, independent of the first software process, to display, independent of the displayed information on the first portion, an alarm graphic element on a second portion of a display, the alarm graphic element including building system event information regarding a second type of building system.

2. The method of claim 1, wherein the first type of building system and the second type of building system are selected from a group consisting of a life safety system, a security system, and a heating, ventilation and air conditioning system.

3. The method of claim 1 wherein step a) further comprises displaying information regarding a life safety system.

4. The method of claim 1 wherein step a) further comprises displaying information regarding a security system.

5. The method of claim 1, further comprising:

c) displaying new information in the first window responsive to a user request; and d) continuing display of the alarm graphic element.

6. The method of claim 1, further comprising:

displaying, subsequent to step b), a second alarm graphic element on the second portion of a display, the second alarm graphic element including building system event information regarding the first type of building system.

7. A method of displaying event information from a building system, comprising:

a) displaying information regarding a first building system on a first portion of a display, the information being selectable and changeable by a user;

b) displaying, independent of the displayed information on the first portion, an alarm graphic element on a second portion of a display, the alarm graphic element including building system event information regarding a second building system;

c) receiving an input selecting one of a plurality of user selectable graphics within the second portion of the display; and d) displaying additional event information from one of a plurality of building systems corresponding to the selected one of the plurality of user selectable graphics.

8. The method of claim 7, further comprising:

displaying, subsequent to step b), a second alarm graphic element on the second portion of a display, the second alarm graphic element including building system event information regarding the first building system.

9. The method of claim 7, wherein the building system event information includes event severity information.

10. The method of claim 9, wherein the event severity information includes graphic elements having a color corresponding to event severity.

11. The method of claim 9, wherein step b) further comprises displaying event type information within the alarm graphic element.

12. An apparatus for displaying event information from a building system, comprising:

a display device;

a processing circuit coupled to the display device, the processing circuit operable to cause the display to display information regarding a first building system in a first portion of the display, the information being selectable and changeable by a user;

cause the display to display, independent of the displayed information in the first portion, an alarm graphic element in a second portion of the display, the alarm graphic element including building system event information pertaining to a second building system;

receive an input selecting one of a plurality of user selectable graphics within the second portion of the display; and cause the display to display additional event information from one of a plurality of building systems corresponding to the selected one of the plurality of user selectable graphics.

13. The apparatus of claim 12 wherein the first building system comprises a first type of building system of a building, and the second building system comprises a second type of building system of the building.

14. The apparatus of claim 13, wherein at least the first type of building system is selected from a group consisting of a life safety system, a security system, and a heating, ventilation and air conditioning system.

15. The apparatus of claim 14, wherein the first type of building system and the second type of building system are selected from a group consisting of a life safety system, a security system, and a heating, ventilation and air conditioning system.

16. The apparatus of claim 12 wherein the processor is further operable to cause the display to display event severity information within in the alarm graphic element.

17. The apparatus of claim 16, wherein the event severity information includes graphic elements having a color corresponding to event severity.

18. The apparatus of claim 16, wherein the processor is further operable to cause the display to display event type information within the alarm graphic element.

* * * * *